US005533409A

United States Patent [19]

Crane et al.

[11] Patent Number: 5,533,409

[45] Date of Patent: Jul. 9, 1996

[54] TORQUE WRENCH WITH ANGULAR MOTION DETECTOR

[75] Inventors: David O. Crane, Lutterworth; Ian B. Golding, Rugby; Robin Crann, Billesdon, all of United Kingdom

[73] Assignee: Crane Electronics Limited, Hinckley, United Kingdom

[21] Appl. No.: 464,653

[22] PCT Filed: Dec. 6, 1993

[86] PCT No.: PCT/GB93/02495

§ 371 Date: Jun. 21, 1995

§ 102(e) Date: Jun. 21, 1995

[87] PCT Pub. No.: WO94/14577

PCT Pub. Date: Jul. 7, 1994

[30] Foreign Application Priority Data

Dec. 24, 1992 [GB] United Kingdom ..... 9226996

[51] Int. Cl.[6] ..... B25B 23/14

[52] U.S. Cl. ..... 73/862.23; 73/862.21

[58] Field of Search ..... 73/862.21, 862.22, 73/862.23, 862.24

[56] References Cited

U.S. PATENT DOCUMENTS

| | | | |
|---|---|---|---|
| 4,091,664 | 5/1978 | Zerver | 73/862.21 |
| 4,262,528 | 4/1981 | Holting et al. | 73/862.23 |
| 4,265,109 | 5/1981 | Hallbauer et al. | 73/862.23 |

*Primary Examiner*—Richard Chilcot
*Assistant Examiner*—Ronald L. Biegel
*Attorney, Agent, or Firm*—Kilgannon & Steidl

[57] ABSTRACT

An angular motion detector, of particular relevance in breakaway point detection, includes a flywheel rotatably mounted on a spindle. The flywheel is provided with one or more indicia, which are detectable by a sensor situated on the object whose angular motion is to be analyzed. The sensor is connected to a microprocessor. In use the flywheel is rotated manually about the spindle so that the regular detection of the indicia by the sensor causes a train of pulses to be sent to the microprocessor. Angular movement of the object, and consequently of the sensor, causes a disruption of the pulse train which can be analyzed to provide information relating to the time of first movement and the magnitude of the angle moved.

6 Claims, 3 Drawing Sheets

TORQUE WRENCH WITH ANGULAR MOTION DETECTOR

DESCRIPTION

1. Field of the Invention

The invention relates to the detection of angular motion, and provides an application of particular relevance and usefulness in torque measurement.

2. Background of the Invention

Many engineering applications involve tightening threaded fasteners, for example nuts and bolts, to within specified torque tolerances. This helps ensure that the performance of the fastenings is reliable and predictable. Fastenings tightened to torques that fall below their specified range can work loose and eventually come undone, whereas those tightened to torques above this range are subject to excessive stresses that can cause failure or eventually weaken the joint. When tightening fastenings, whether by hand or powered tool, means are required to give independent verifications of the applied torque.

In carrying out Quality Control testing on fastenings, it is often necessary to discover the torque to which any particular fastening has been tightened. To do this, the operator applies a gradually increasing torque to the tightened fastening. Initially there is no relative motion of nut and bolt, i.e. no further tightening of the fastening, because the torque to overcome static friction has not yet been reached. On continued application of increasing torque a point is eventually reached at which the nut begins to move relative to the bolt and further tightening of the fastening commences. This is felt by the operator as a sudden movement of the initially stationary torque wrench, and is known as the breakaway point. The torque applied to the fastening at the precise moment that this movement starts is an indication of the torque to which the fastening was originally tightened. It is known as the breakaway torque, and it is this value that is commonly recorded and used in a Quality Control Programme.

If the operator continues to apply torque after the breakaway point is reached, the fastening becomes tightened to a higher torque than it was initially. If the specified torque tolerance for the fastening is narrow, this may mean that the fastening is overtightened, and hence weakened. It is therefore desirable that the breakaway point is detected quickly and reliably if the testing of a fastening is not to degrade that fastening.

The traditional method of breakaway point detection in which the operator simply records the value of torque displayed by the torque wrench at the point when he judges movement of the wrench to commence, is subject to a number of limitations. The time at which movement is first detected depends on the sensitivity of the operator, who is required to see or feel for movement of the wrench. A particularly heavy handed operator may overtighten and therefore degrade the joint he is supposed to be testing. The nature of the joint, which may be "hard" or "soft" will influence the ability to detect breakaway point and the reliability of the peak reading achieved.

It is an object of the present invention to provide a detector which is able to sense the commencement of breakaway virtually instantaneously and to record an accurate reading of the torque applied at that breakaway point.

SUMMARY OF THE INVENTION

The invention provides apparatus for providing information relating to the angular movement of, and torque applied to, a threaded fastener comprising:

a torque wrench:

a torque sensor:

a flywheel rotatably mounted on the torque wrench;

means for connecting the torque wrench to the threaded fastener so that the flywheel axis lies in the same plane as the fastener axis:

sensor means associated with one or more peripheral indicia on the flywheel, for sensing the proximity of the indicia relative to a given point on the torque wrench to establish a pulse output when the flywheel is rotated:

a microprocessor for monitoring the pulse output to provide information relating to the angular movement of the torque wrench about the axis of the fastener, and for monitoring the output of the torque sensor to provide information about the applied torque; and memory means for retaining the information so monitored.

The number of indicia on the flywheel generally depends on the nature of the flywheel and its intended speed of rotation. Large, high inertia flywheels are usually rotated at lower angular speeds than smaller lighter wheels, and so a greater number of indicia would be required to give a sufficiently high frequency pulse output.

The memory means, which may be the microprocessor memory, stores the values of the applied torque and the rotation of the torque wrench throughout the whole testing procedure. It is therefore not necessary for the operator to attempt to judge the applied torque at the exact moment of breakaway: the microprocessor analyses the data and does this automatically. It is also able to provide values of the torque applied or the angle moved at any specified time.

DRAWINGS

Figure 1:
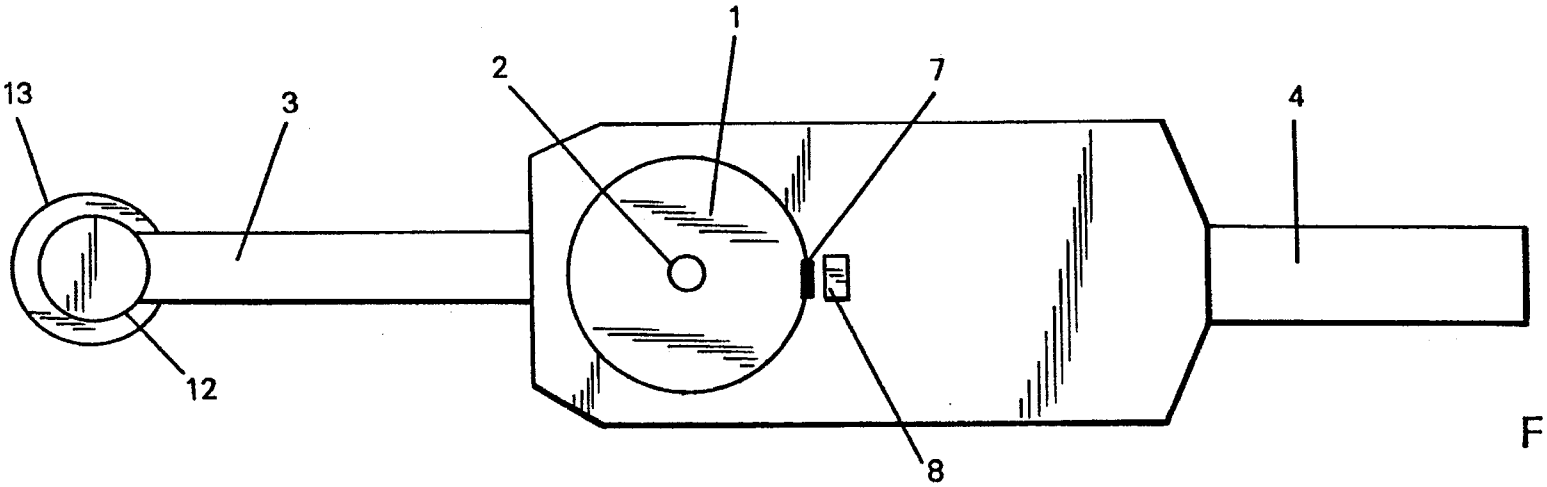
FIG. 1 is a plan view of a breakaway point detector according to the invention.
Figure 2:
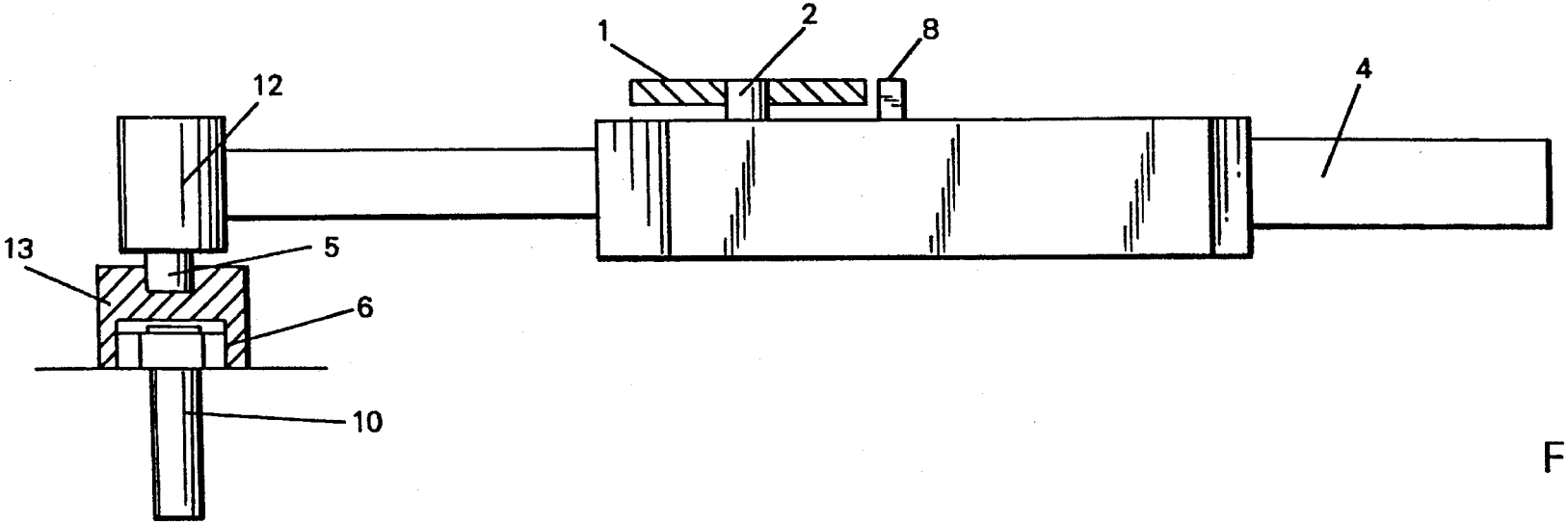
FIG. 2 is a side elevation of the detector of FIG. 1.
Figure 6:
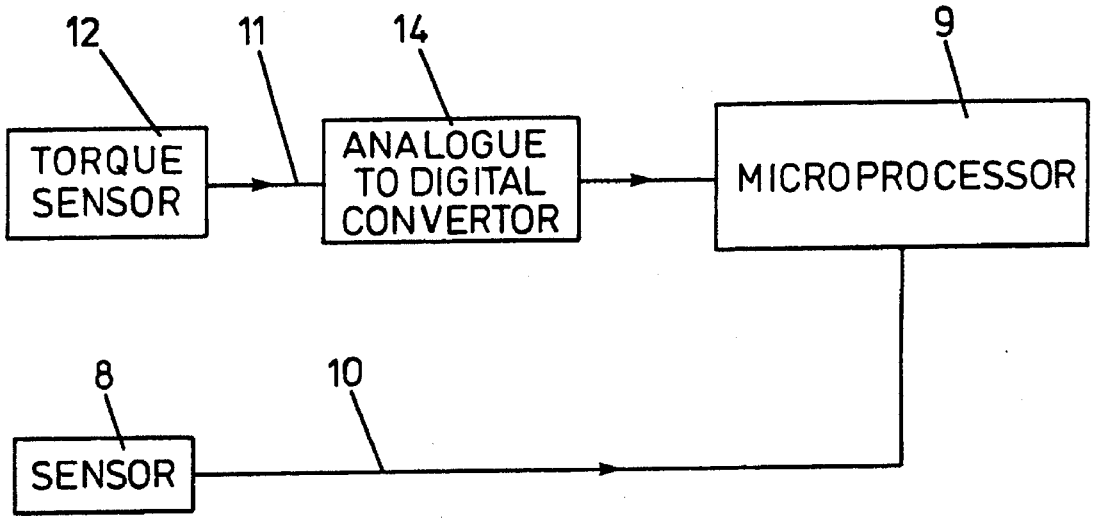
FIG. 6 is an interconnection drawing of the main electrical components.

Referring to FIGS. 1, 2 and 6 a flywheel 1 is mounted on a spindle 2 so as to be freely rotatable thereabout. The spindle 2 is attached to a torque wrench 3 which comprises a wrench handle 4 and a square drive 5. The spindle may be attached to the torque wrench at any point along its length, and its axis should be parallel to that of the fastener. The torque wrench 3 includes a torque sensor 12 which provides a continuous reading of the torque applied by the wrench. This reading is received by a microprocessor 9 via an electrical connection 11 and an analogue to digital convertor 14.

On the torque wrench 3 is a sensor 8 which is associated with one or more indicia 7 situated on the flywheel 1, at or near its circumference. On detecting the proximity of the indicia 7, the sensor 8 sends a signal to the microprocessor via an electrical connection 10.

To operate the detector, the square drive 5 is fitted with an appropriately sized socket 13 which is then fitted onto the fastening to be tested (nut 6 and bolt 10). The flywheel 1 is made to rotate briskly, for instance by spinning manually around the spindle 2 and a gradually increasing torque is applied to the fastener.

Figure 3:
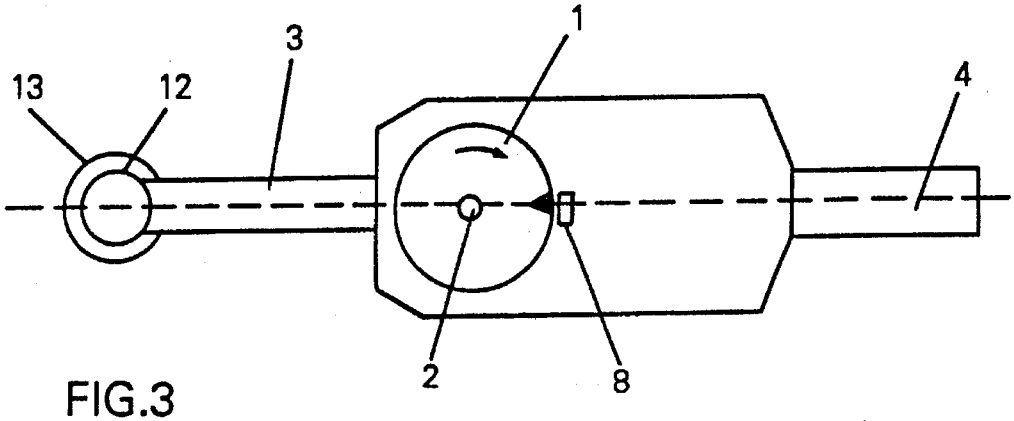
FIG. 3 is a schematic plan view of the detector prior to the moment of breakaway.
Figure 5:
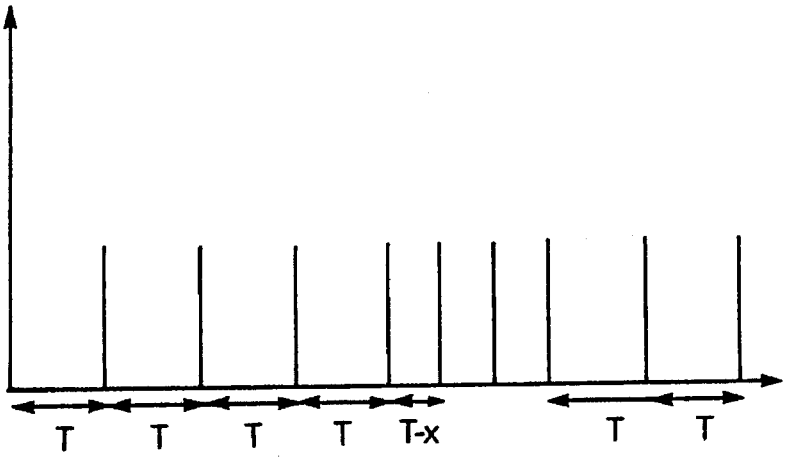
FIG. 5 is a representation of the input to the microprocessor from the sensor.

At the low torque initially applied to the fastener there is no movement of the nut 6 and hence no rotation of the wrench handle 4 (FIG. 3). The rotation of the flywheel 1 about the spindle 2 causes the regular detection of the indicia by the sensor and the resultant sending of a regular pulse output to the microprocessor 9, the frequency of the pulse being related to the frequency of rotation of the flywheel 1. The period of these regular pulses is shown as T in FIG. 5.

Figure 4:
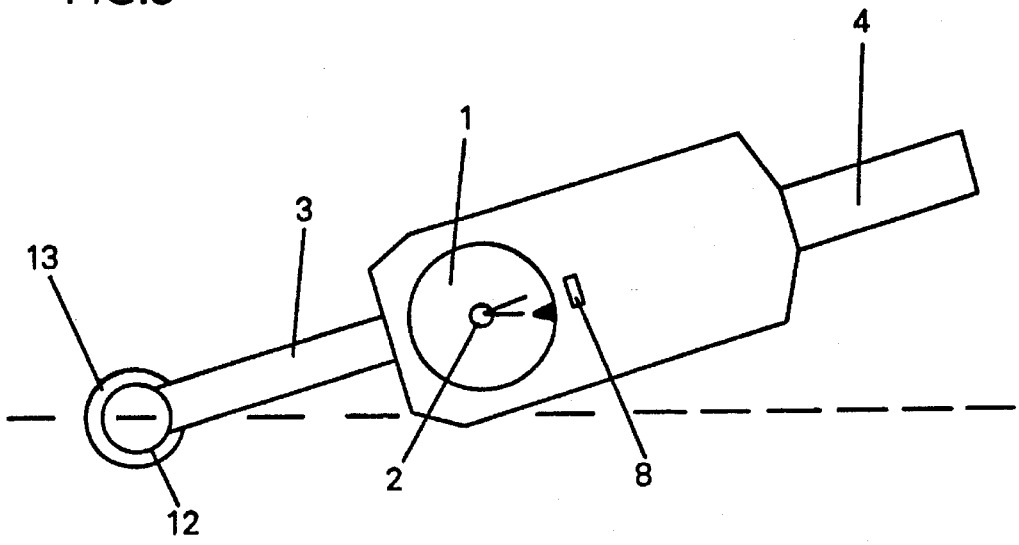
FIG. 4 is the detector of FIG. 3, after breakaway.

On continued application of increasing torque, the fastener eventually reaches its breakaway point, and the nut 6 moves, thereby allowing rotation of the wrench handle 4 (FIG. 4). Rotation of the wrench handle 4 causes the relative positions of the sensor 8 and the indicia 7 on the flywheel 1 to be altered, so that the indicia is detected sooner or later than would be expected due to the normal rotation of the flywheel, and the period of the signals sent from the sensor 8 to the microprocessor 9 changes abruptly. This is shown clearly in FIG. 5. The period in which the first motion of the torque wrench, and therefore breakaway, occurs has a duration T-x where the value of x depends on factors such as the degree and speed of the motion of the torque wrench. Because the frequency of detection of indicia is high, the disruption of the signals occurs almost immediately on rotation of the wrench handle 4, and the breakaway point is detected virtually instantaneously. The period does not settle down to the expected value again until the nut 6, and hence the wrench handle 4, ceases to rotate. The disruption of the signals is independent of the position of the spindle 2 and flywheel 1 on the torque wrench 3, as this affects only the lateral movement of the flywheel and has no bearing on its rotation.

The measurements are so precise that even the minimal slowing of the flywheel due to friction could limit the accuracy of the method. To avoid this, a calibration run is carried out prior to the use of the instrument so that the microprocessor memory contains information about the rate of slowing of the flywheel as a function of its speed, and can predict exactly when to expect signals under normal conditions.

The microprocessor may be programmed to produce a signal, perhaps a noise, on detection of breakaway, in order that the operator can immediately cease to apply torque. The microprocessor is also able to calculate the angle through which the torque wrench moves by comparing the monitored pulse output with an expected pulse output, summing the differences therebetween to give a total difference value and using this difference value and the period of rotation of the flywheel, to calculate the angular distance moved by the torque wrench. The microprocessor may be programmed to calculate the angle moved in a particular time period or to relate angular movement information to torque information in order to provide, for example, a value of the angle moved through at any particular torque.

We claim:

1. Apparatus for providing information relating to the angular movement of, and torque applied to, a threaded fastener comprising:

a torque wrench;

a torque sensor;

a flywheel rotatably mounted on the torque wrench;

means for connecting the torque wrench to the threaded fastener so that the flywheel axis lies in the same plane as the fastener axis;

sensor means associated with one or more peripheral indicia on the flywheel, for sensing the proximity of the indicia relative to a given point on the torque wrench to establish a pulse output when the flywheel is rotated;

a microprocessor for monitoring the pulse output to provide information relating to the angular movement of the torque wrench about the axis of the fastener, and for monitoring the output of the torque sensor to provide information about the applied torque; and memory means for retaining the information so monitored.

2. Apparatus according to claim 1 wherein the microprocessor contains summing means for calculating the angular distance moved by the torque wrench about the axis of the fastener.

3. Apparatus according to claim i wherein the flywheel is freely rotable about its axis and may be spun by hand.

4. A method for providing information relating to the angular movement of, and torque applied to, a threaded fastener using apparatus according to any preceding claim wherein the flywheel is rotated and the resultant pulse output monitored;

a gradually increasing torque is applied to the fastener by the torque wrench; and the output of the torque sensor is monitored;

any deviation of the monitored pulse output from an expected pulse output is interpreted by the microprocessor as indicating breakaway; and the torque measured by the torque wrench at this point is taken to be the breakaway torque.

5. A method according to claim 4 wherein the time periods of the monitored pulse output are compared with those of an expected pulse output; the differences therebetween are summed to give a total difference value; and this total difference value is used to calculate the angular distance moved by the torque wrench, about the axis or the fastener.

6. A method of calibrating an apparatus according to claim 3 wherein an expected pulse output is established by performing a calibration run in which the flywheel is rotated and the microprocessor made to store information relating to the lengthening of the pulse period due to the frictional slowing of the flywheel.

* * * * *